US005597289A

United States Patent [19]

Thut

[11] Patent Number: 5,597,289

[45] Date of Patent: Jan. 28, 1997

[54] DYNAMICALLY BALANCED PUMP IMPELLER

[76] Inventor: Bruno H. Thut, 16755 Park Circle Dr., Chagrin Falls, Ohio 44023

[21] Appl. No.: 399,451

[22] Filed: Mar. 7, 1995

[51] Int. Cl.[6] ..... F04D 7/06

[52] U.S. Cl. ..... 415/200; 415/217.1; 416/185; 416/241 B

[58] Field of Search ..... 416/182, 185, 416/202, 223 B, 238, 241 B; 415/200, 217.1

[56] References Cited

U.S. PATENT DOCUMENTS

| | | |
|---|---|---|
| 485,906 | 11/1892 | Brown . |
| 2,054,923 | 9/1936 | Betterton et al. . |
| 2,072,650 | 3/1937 | Schmeller, Sr. . |
| 2,294,135 | 8/1942 | Smith . |
| 2,383,424 | 8/1945 | Stepanoff . |
| 2,493,467 | 1/1950 | Sunnen . |

(List continued on next page.)

FOREIGN PATENT DOCUMENTS

| | | | |
|---|---|---|---|
| 1264126 | 1/1990 | Canada . | |
| 2097648 | 12/1993 | Canada . | |
| 0586800 | 3/1994 | European Pat. Off. . | |
| 1024602 | 4/1953 | France . | |
| 1382504 | 11/1964 | France . | |
| 2376310 | 7/1978 | France . | |
| 3-164594 | 7/1991 | Japan | 416/241 B |
| 365991 | 1/1932 | United Kingdom | 416/188 |
| 715923 | 9/1954 | United Kingdom | 416/185 |

OTHER PUBLICATIONS pp. 330–340 (Chapt. 11) from Physics, Worth Publishers, Inc., Copyrighted 1982.

One page Advertisement for L–Series molten metal pumps by Metaullics Systems Co., undated.

One page advertisement for M. Series Aluminum Molten Metal Pumps by Metsullics Systems Co., undated.

One page schomatic drawing of a molten metal pump, source unknown, undated.

Six page brochure for "M Series" molten metal pumps by Metaullics Systems Co., copyright 1984.

Sixteen page operating instruction booklet for Metaullics Transfer Pumps for Molten Metal by the Carborumdum Company, copyright 1980.

Sixteen page operating instruction booklet for Metaullics De–Gas/De–Mag systems for Aluminum, Metaullics Systems Co., dated Apr. 1, 1985.

Sixteen page operating instruction booklet for Metaullics Transfer Pump Systems for Molten Metals, Metaullics Systems Co., copyright 1984.

Four page folder listing models of molten metal pumps by High Temperature Systems, Inc., published at least as early as Jun., 1990.

One page advertisement for replacement parts for M9000CSD Gas Injection Pump, High Temperature Systems, Inc., published at least as early as Oct. 1986.

One page advertisement for replacement parts for A5000C and A9000C Molten Metal Pump, High Temperature Systems, Inc., published at least as early as Sep., 1977.

One page advertisement for replacement parts for M50000CSD Gas Injection Pump, High Temperature Systems, Inc. published at least as early as Oct., 1986.

One page advertisement for replacement parts for M5000C Molten Metal Pump, High Temperature Systems, Inc. dated Jul., 1986.

(List continued on next page.)

*Primary Examiner*—James Larson

*Attorney, Agent, or Firm*—Watts, Hoffmann, Fisher & Heinke

[57] ABSTRACT

In a non-metallic pump for pumping molten metal including a shaft, a motor at one end of the shaft, an impeller at the other end of the shaft, and a base having a chamber in which the impeller is rotatable, the improvement being a dynamically balanced impeller comprising a cylindrical center hub and five vanes extending outwardly from the hub, wherein the vanes are equally spaced around the periphery of the hub.

7 Claims, 3 Drawing Sheets

U.S. PATENT DOCUMENTS

| | | | |
|---|---|---|---|
| 2,528,208 | 10/1950 | Bonsack et al. . | |
| 2,528,210 | 10/1950 | Stewart | 415/200 |
| 2,779,574 | 1/1957 | Schneider . | |
| 2,808,782 | 10/1957 | Thompson et al. . | |
| 2,824,520 | 2/1958 | Bartels . | |
| 2,948,524 | 8/1960 | Sweeney . | |
| 2,978,885 | 4/1961 | Davison . | |
| 3,048,384 | 8/1962 | Sweeney et al. | 415/217.1 |
| 3,070,393 | 12/1962 | Silverberg et al. . | |
| 3,092,030 | 6/1963 | Wunder . | |
| 3,227,547 | 1/1966 | Szekely . | |
| 3,255,702 | 6/1966 | Gehrm . | |
| 3,276,758 | 10/1966 | Baker et al. . | |
| 3,291,473 | 12/1966 | Sweeney . | |
| 3,459,133 | 8/1969 | Scheffler | 415/217.1 |
| 3,532,445 | 10/1970 | Scheffler, Jr. et al. | 415/217.1 |
| 3,573,895 | 4/1971 | Ostberg . | |
| 3,575,525 | 4/1971 | Fox et al. . | |
| 3,608,621 | 9/1971 | Bolling et al. . | |
| 3,650,513 | 3/1972 | Werner . | |
| 3,650,516 | 3/1972 | Mantell et al. . | |
| 3,690,621 | 9/1972 | Tanaka et al. . | |
| 3,719,436 | 3/1973 | MaFaclin . | |
| 3,759,635 | 9/1973 | Carter et al. . | |
| 3,767,382 | 10/1973 | Bruno et al. . | |
| 3,776,660 | 12/1973 | Anderson et al. | 415/200 |
| 3,791,813 | 2/1974 | Ramachandran et al. . | |
| 3,792,848 | 2/1974 | Ostberg . | |
| 3,801,003 | 4/1974 | Racunas et al. . | |
| 3,814,396 | 6/1974 | Di Gregorio et al. . | |
| 3,836,280 | 9/1974 | Koch . | |
| 3,839,019 | 10/1974 | Bruno et al. . | |
| 3,861,660 | 1/1975 | Ammann et al. . | |
| 3,862,839 | 1/1975 | Shimizu et al. . | |
| 3,870,511 | 3/1975 | Szekely . | |
| 3,871,872 | 3/1975 | Bowning et al. . | |
| 3,873,305 | 3/1975 | Claxton et al. . | |
| 3,887,172 | 6/1975 | Funck et al. . | |
| 3,953,552 | 4/1976 | Strauss . | |
| 3,955,970 | 5/1976 | Claxton et al. . | |
| 3,984,234 | 10/1976 | Claxton et al. . | |
| 3,997,336 | 12/1976 | van Linden et al. . | |
| 4,047,938 | 9/1977 | Szekaly . | |
| 4,052,199 | 10/1977 | Mangalick . | |
| 4,088,502 | 5/1978 | La Bar . | |
| 4,116,659 | 9/1978 | Matesa et al. . | |
| 4,128,415 | 12/1978 | van Linden et al. . | |
| 4,169,584 | 10/1979 | Mangalick . | |
| 4,188,287 | 2/1980 | Faulkner et al. . | |
| 4,283,357 | 8/1981 | Sidery . | |
| 4,287,137 | 9/1981 | Sonoyama et al. . | |
| 4,297,214 | 10/1981 | Guarnaschelli . | |
| 4,322,245 | 3/1982 | Claxton . | |
| 4,351,514 | 9/1982 | Koch . | |
| 4,410,299 | 10/1983 | Shimoyama . | |
| 4,425,232 | 1/1984 | Lawrence et al. . | |
| 4,426,068 | 1/1984 | Gimond et al. . | |
| 4,454,078 | 6/1984 | Engelbrecht et al. . | |
| 4,470,846 | 9/1984 | Dubé. | |
| 4,486,228 | 12/1984 | Ormesher . | |
| 4,491,474 | 1/1985 | Ormesher . | |
| 4,518,424 | 5/1985 | Ormesher . | |
| 4,592,658 | 6/1986 | Claxton . | |
| 4,598,899 | 7/1986 | Cooper . | |
| 4,607,959 | 8/1986 | Miyazaki et al. . | |
| 4,664,592 | 5/1987 | Grzina . | |
| 4,673,434 | 6/1987 | Withers et al. . | |
| 4,747,583 | 5/1988 | Gordon et al. . | |
| 4,786,230 | 11/1988 | Thut | 415/200 |
| 4,842,227 | 6/1989 | Harrington et al. . | |
| 4,898,367 | 2/1990 | Cooper . | |
| 4,930,986 | 6/1990 | Cooper . | |
| 4,940,384 | 7/1980 | Amra et al. . | |
| 4,954,167 | 9/1990 | Cooper . | |
| 4,960,163 | 10/1990 | Fang et al. . | |
| 5,025,198 | 6/1991 | Mordue et al. . | |
| 5,028,211 | 7/1991 | Mordue et al. . | |
| 5,078,572 | 1/1992 | Amra et al. . | |
| 5,088,893 | 2/1992 | Gilbert et al. . | |
| 5,092,821 | 3/1992 | Gilbert et al. . | |
| 5,098,134 | 5/1992 | Monckton . | |
| 5,131,632 | 7/1992 | Olson . | |
| 5,143,357 | 9/1992 | Gilbert . | |
| 5,160,693 | 11/1992 | Eckert et al. . | |
| 5,165,858 | 11/1992 | Gilbert et al. | 416/223 B |
| 5,177,035 | 1/1993 | Gee et al. . | |
| 5,181,828 | 1/1993 | Gilbert et al. . | |
| 5,192,193 | 3/1993 | Cooper et al. . | |
| 5,203,681 | 4/1983 | Cooper . | |
| 5,268,020 | 12/1993 | Claxton . | |
| 5,294,245 | 3/1994 | Gilbert et al. . | |
| 5,308,045 | 5/1994 | Cooper . | |
| 5,310,412 | 5/1994 | Gilbert et al. . | |
| 5,330,328 | 7/1994 | Cooper . | |
| 5,364,450 | 11/1994 | Eckert . | |
| 5,435,960 | 7/1995 | Bressler et al. . | |
| 5,462,580 | 10/1995 | Eckert . | |
| 5,462,581 | 10/1995 | Eckert . | |
| 5,470,201 | 11/1995 | Gilbert et al. . | |

OTHER PUBLICATIONS

Four page installation booklet for Mark II molten metal pumps, High Temperature Systems, Inc., published at least as early as Sep. 1973.

Fourteen page operating instruction booklet for Metaullics Circulation Systems for Aluminum, Metaullics Systems Co., copyright 1984.

Two page advertisement describing exhibit, High Temperature Systems, Inc., 1995 TMS Annual Meeting Exhibition.

Five page article for Reduced Fuel Consumption through . . . Mechanized Molten Metal Circulation, The Carboradum Company, published by The Society of Die Casting Engineers, vol. 17, No. 5, pp. 22–31, Sep.–Oct. 1973.

29 page operating instruction booklet, High Temperature Systems, Inc., undated.

"Fluid Mechanics"; Frank M. White; Second Edition, pp. 633–642, copyright 1986.

High Temperature Systems, Inc., "H.T.S. Pump Equation For The Eighties" publication.

DYNAMICALLY BALANCED PUMP IMPELLER

FIELD OF THE INVENTION

This invention relates to pumps for pumping molten metal and more particularly to impellers used in such pumps.

BACKGROUND OF THE INVENTION

Pumps used for pumping molten metal typically include a motor carried by a motor mount, a shaft connected to the motor at one end, and an impeller connected to the other end of the shaft. Such pumps may also include a base with an impeller chamber, the impeller being rotatable in the impeller chamber. Support members extend between the motor mount and the base and include a shaft sleeve surrounding the shaft, support posts, and a tubular riser. A volute member may be employed in the impeller chamber. Pumps are designed with pump shaft bearings, impeller bearings and with bearings in the base that surround these bearings to avoid damage of the shaft and impeller due to contact with the shaft sleeve or base. The shaft, impeller, and support members for such pumps are immersed in molten metals such as aluminum, copper, iron and alloys thereof. The pump components that contact the molten metal are composed of a refractory material such as graphite.

The pumps commonly used to pump molten metal are one of three types, transfer pumps, discharge pumps, and circulation pumps, as disclosed in the publication "H.T.S. Pump Equation for the Eighties" by High Temperature Systems, Inc., which is incorporated herein by reference in its entirety.

A transfer pump transfers molten metal out of one furnace to another furnace or into a ladle. The transfer pump has all of the pump components described above. A tubular riser extends vertica from the base chamber to the motor mount and contains a passageway for molten metal. Support posts are also provided between the base and the motor mount.

A discharge pump transfers molten metal from one bath chamber through a submerged pipe to another bath chamber. Such a pump typically includes a shaft sleeve and support posts between the base and the motor mount, but has no riser.

A circulation pump circulates molten metal to improve alloy homogenization, among other things. A circulation pump may also be configured without a base, shaft sleeve, support posts or riser, having only an impeller connected to a shaft sleeve immersed in the molten metal, as described in U.S. Pat. No. 5,143,357 to Gilbert et al., issued Sep. 1, 1992. However, a circulation pump could include all of the pump components described above except a riser.

The operation of all three types of pumps is similar. The pump is lowered into a bath of molten metal and secured in place. The motor is activated and rotates the shaft via a coupling assembly between the shaft and motor. The shaft then rotates the impeller, thereby effecting fluid flow of the molten metal.

In the operation of circulation pumps without a base, the molten metal is then circulated in the furnace by rotation of the impeller on the end of the shaft. In circulation pumps having a base, rotation of the impeller draws molten metal into the impeller chamber of the base and out of an outlet of the base in a desired direction.

In the operation of transfer pumps, rotation of the impeller draws molten metal into the impeller chamber of the base and out a base outlet to the riser. The molten metal then passes through the riser and is removed from the pump.

In the operation of discharge pumps, rotation of the impeller draws molten metal into the inlet and out of the outlet of the base. The molten metal then passes through the submerged pipe into another bath chamber.

Pumps which employ a base may either be top feed pumps or bottom feed pumps depending, among other things, on the configuration of the base and orientation of the impeller vanes relative to the direction of shaft rotation. Multiple impellers and volutes may be used, as disclosed in U.S. Pat. No. 4,786,230 to Thut, which is incorporated herein by reference in its entirety.

Impellers have been used in pumps of the types described with two, three, and as many as four blades. An impeller is connected to one end of a long shaft. The impeller is typically constructed of refractory material by machining. When the impeller is connected to the end of the shaft it invariably vibrates or wobbles. The refractory impeller cannot be produced to eliminate all wobble on the end of the shaft.

Three bladed cylindrical hub impellers have high displacement of molten metal. However, using a three-bladed impeller is disadvantageous in that it is not well balanced and wobbles excessively. The disadvantage of using an impeller with more than three blades is that as more blades are used, displacement of the molten metal is reduced.

In many instances two and four bladed cylindrical hub impellers offer the advantage of better balance and less wobble than three bladed, cylindrical hub impellers. However, two and four bladed cylindrical hub impellers suffer from a repeated impact problem. When pumping molten metal the impeller bearing and shaft bearing repeatedly strike their surrounding bearings at the same radial locations on the periphery of the impeller bearing and shaft bearing. This so-called chatter results in relatively rapid destruction of at least one of the shaft, impeller bearing, and impeller. Typically, the pump shaft is sheared. The short useful lives of the pump shaft, impeller, and impeller bearing lead to increased production costs attributable to frequent replacement of the pump components and consequential down time of the pump.

SUMMARY OF THE INVENTION

The dynamically balanced pump impeller of the present invention overcomes all of the vibration problems associated with prior art cylindrical hub two and four bladed impellers. The present impeller has the advantage of maximum displacement without excessive wobble and does not suffer from the repeated impact problems that occur with cylindrical hub two and four bladed impellers. The present impeller can be used in transfer pumps, discharge pumps and circulation pumps of the types described.

The present impeller is made of a non-metallic heat-resistant material and is dynamically balanced by being designed to have a cylindrical center hub and five vanes extending outwardly from the hub. The vanes are equally spaced around the periphery of the hub. When less than five vanes are used, the impeller suffers from the problems of the prior art and is destroyed by repeated impact between, e.g., the base bearing and the impeller bearing on the same radial locations on the periphery of the impeller bearing. Using five vanes dynamically balances the present impeller and evenly distributes the effects of vibration. As a result, the impeller bearing does not strike the corresponding base bearing at the same radial locations on the periphery of the impeller bearing. Instead, each impact with the base bearing occurs at a different radial location on the periphery of the impeller bearing than the preceding impact. This results in prolonged life of the shaft, the impeller bearing, and the impeller.

In preferred form the invention is a dynamically balanced impeller including a circular base and a cylindrical hub portion centrally located on one surface of the base. The hub portion has an inner surface that defines a cylindrical bore and is internally threaded. Five vanes extend outwardly from the hub to the circumference of the base. The vanes are equally spaced around the periphery of the hub, extend tangentially from the hub, and have a rectangular cross section. The vanes have a root portion adjacent to the base and a tip portion remote from the base, the root portion being wider than the tip portion.

DESCRIPTION OF PREFERRED EMBODIMENTS

Figure 1:
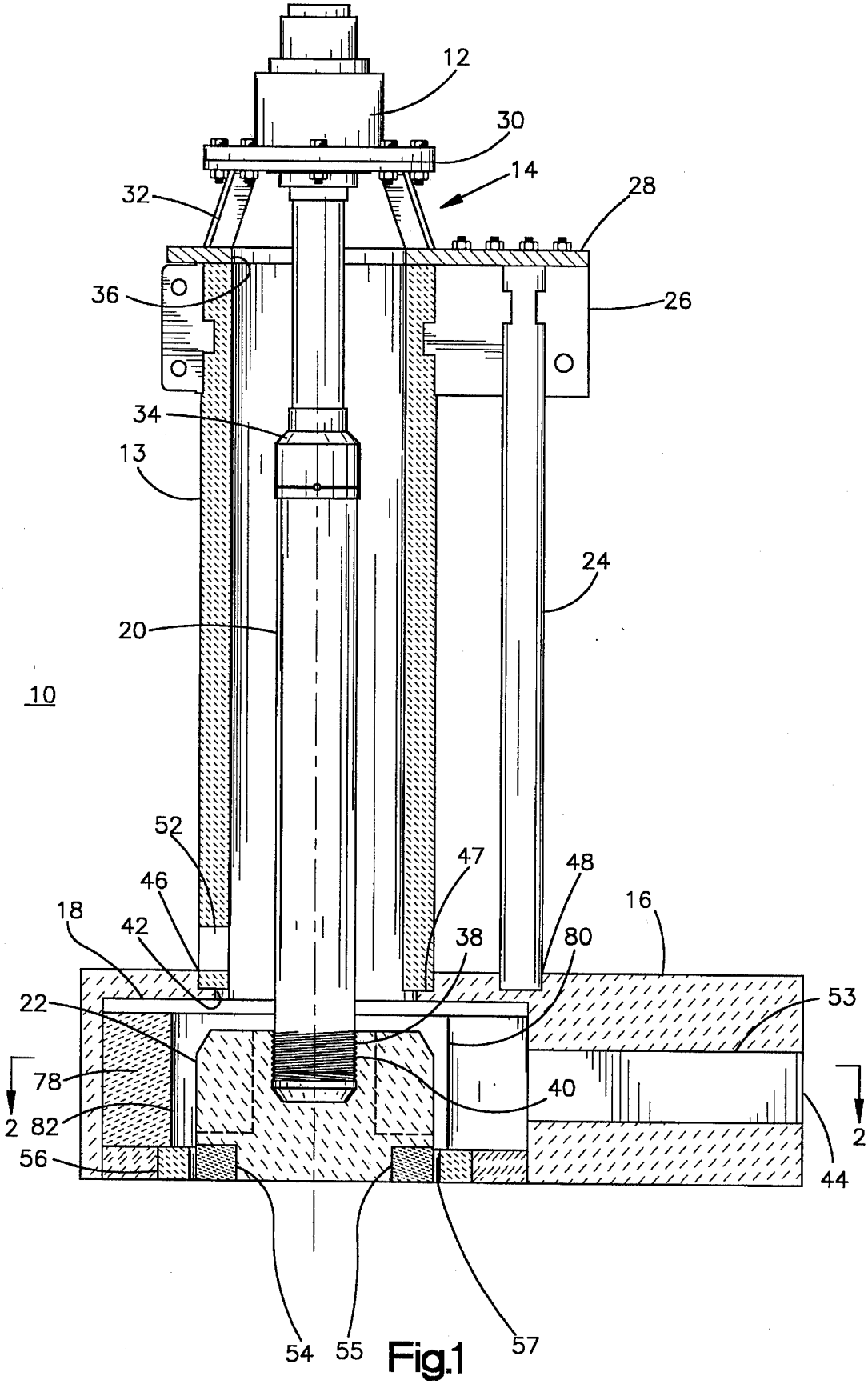
FIG. 1 is a vertical cross-sectional view of a discharge pump employing an impeller constructed in accordance with the invention.
Figure 2:
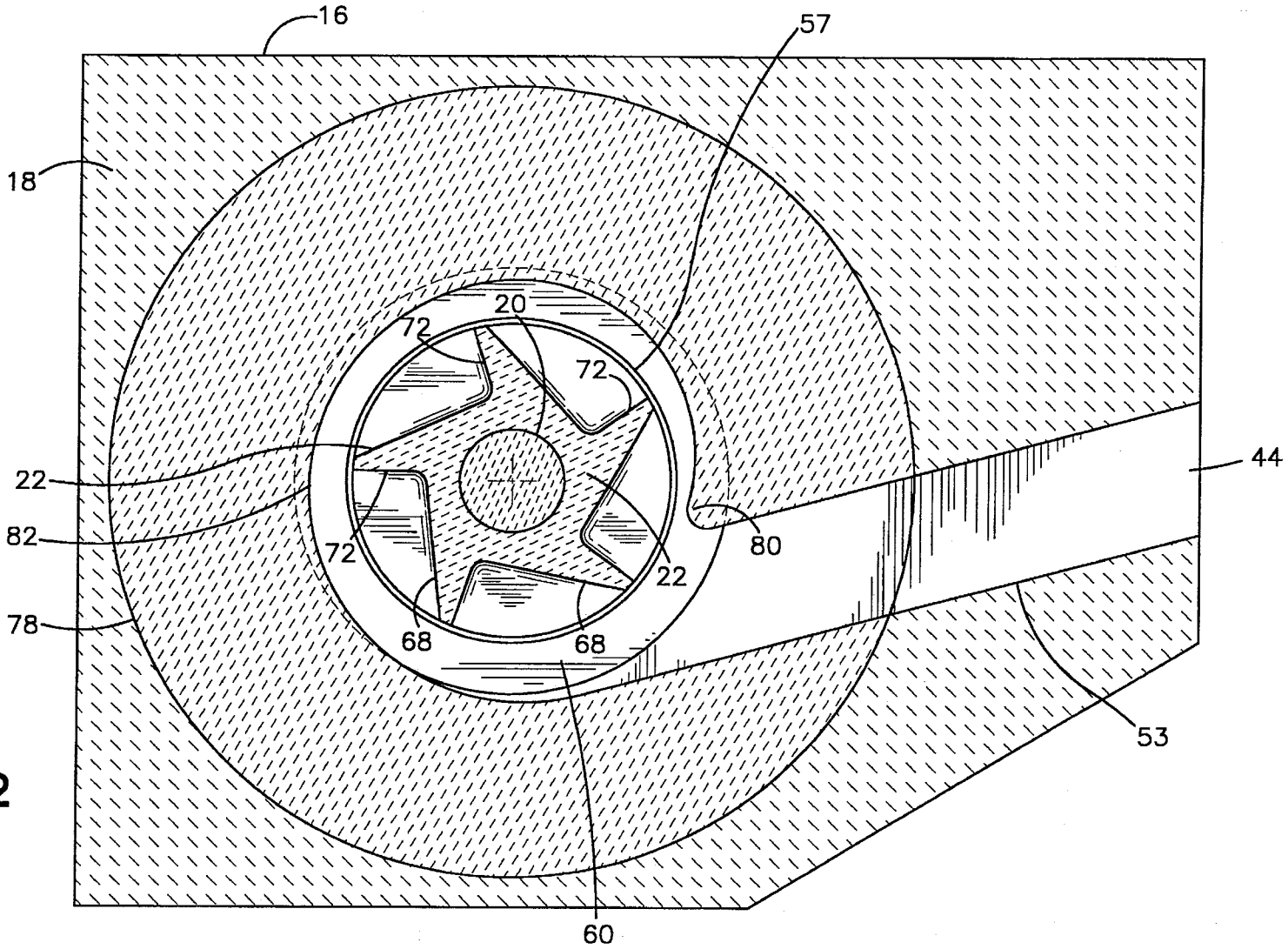
FIG. 2 is a cross-sectional view as seen from a plane taken along the lines 2—2 of FIG. 1.

Referring now to the drawings and to FIGS. 1 and 2 in particular, the illustrated pump is generally designated by reference numeral 10 and is shown as a so-called top feed discharge pump that includes a motor 12 mounted to a motor mount 14. A base 16 has an impeller chamber 18 formed therein. A shaft 20 is connected to the motor 12 at one end. An impeller 22 is connected to the other end of the shaft 20 and is rotatable in the impeller chamber 18. A shaft sleeve 13 surrounds the shaft 24. The shaft sleeve 13 and a support post 24 are disposed between the motor mount 14 and the base 16. The shaft sleeve 13 and the support post 24 have their lower ends fixed to the base 16. A quick release clamp 26 is carried by the motor mount 14. The quick release clamp is of the type described in U.S. patent application Ser. No. 08/385,357 to Thut, entitled "Pumps for Pumping Molten Metal", filed Feb. 8, 1995 which is incorporated herein by reference in its entirety. The clamp 26 releasably clamps corresponding upper end portions of the shaft sleeve 13 and the support post 24.

It should be apparent that the invention is not limited to any particular pump construction, but rather may be used with any construction of transfer, discharge, or circulation pump of the types described. Although the invention has been shown used in a top-feed pump, it is also suitably used in a bottom feed pump. If used in a bottom feed pump the impeller 22 is inverted from the orientation shown in FIG. 1. Moreover, more than one of the present impellers 22 may be used, such as in a dual volute impeller pump of the type described by U.S. Pat. No. 4,786,230 to Thut.

The motor mount 14 comprises a flat mounting plate 28 including a motor support portion 30 supported by legs 32. A hanger (not shown) may be attached to the motor mount 14 for hoisting the pump 10 into and out of the furnace. The motor 12 is an air motor or the like, directly mounted onto the motor support portion 30.

The shaft 20 is connected to the motor 12 by a coupling assembly 34 which is preferably constructed in the manner shown in U.S. patent application Ser. No. 08/336,987 to Thut, filed Nov. 10, 1994, entitled "Shaft Coupling For A Molten Metal Pump", the disclosure of which is incorporated herein by reference in its entirety. The motor mount 14 shown in FIG. 1 includes an opening 36 in the mounting plate 28, which permits connecting the motor 12 to the shaft 20 by the coupling assembly 34.

The base 16 has an impeller chamber 18 with a molten metal inlet opening 42 and a molten metal base passage 53 leading to a base outlet opening 44. An opening 46 surrounding the base inlet opening 42 receives the shaft sleeve 13. A shoulder 47 is formed in the base 16 around the inlet opening 42, and supports the shaft sleeve 13. The shaft sleeve 13 is cemented in place on the shoulder 47. The shaft sleeve 13 contains multiple inlet openings 52 adjacent the base 16. An opening 48 in the base 16 receives the post 24. The post 24 is cemented in place in the opening 46.

The impeller 22 is attached to one end portion of the shaft 20 such as by engagement of exterior threads 38 formed on the shaft 20 with corresponding interior threads 40 formed in the impeller 22. However, any connection between the shaft 20 and the impeller 22, such as a keyway or pin arrangement, or the like, may be used.

The impeller 22 includes a circular base 60 having an outer peripheral surface 62, and an upper surface portion 64 and a lower surface portion 66. A cylindrical hub 58 is centered on and extends from the upper portion 64 of the base 60. Five vanes 68 extend tangentially from the hub 58 above the upper portion 64, preferably to the outer peripheral surface 62 of the base 60.

The impeller 22 preferably includes an annular groove 55 at one end portion, which receives an impeller bearing 54. The bearing 54 is secured in the groove 55 such as by cementing or the like. The impeller bearing 54 is made of high strength refractory material, such as a ceramic material including silicon carbide or silicon nitride. The impeller 22 is preferably machined from graphite. If the impeller 22 is comprised of a high strength refractory material, the impeller bearing 54 may be omitted.

The annular impeller bearing 54 is circumscribed by an annular base bearing 56 disposed at a lower portion of the base 16. The bearings 54 and 56 protect the impeller 22 from striking the base 16. There is an annular gap 57 between the base bearing 56 and the impeller bearing 54 to allow for rotation of the impeller 22. The impeller bearing 54 and the base bearing 56 are employed to prolong the life of the impeller 22, since during vibration the impeller 22 will not strike the base bearing 56 or the base 50, but rather its impeller bearing 54 will strike the base bearing 56. The impeller 22 optionally includes an upper bearing and the pump 10 optionally includes a corresponding bearing surrounding the upper impeller bearing.

Figure 3:
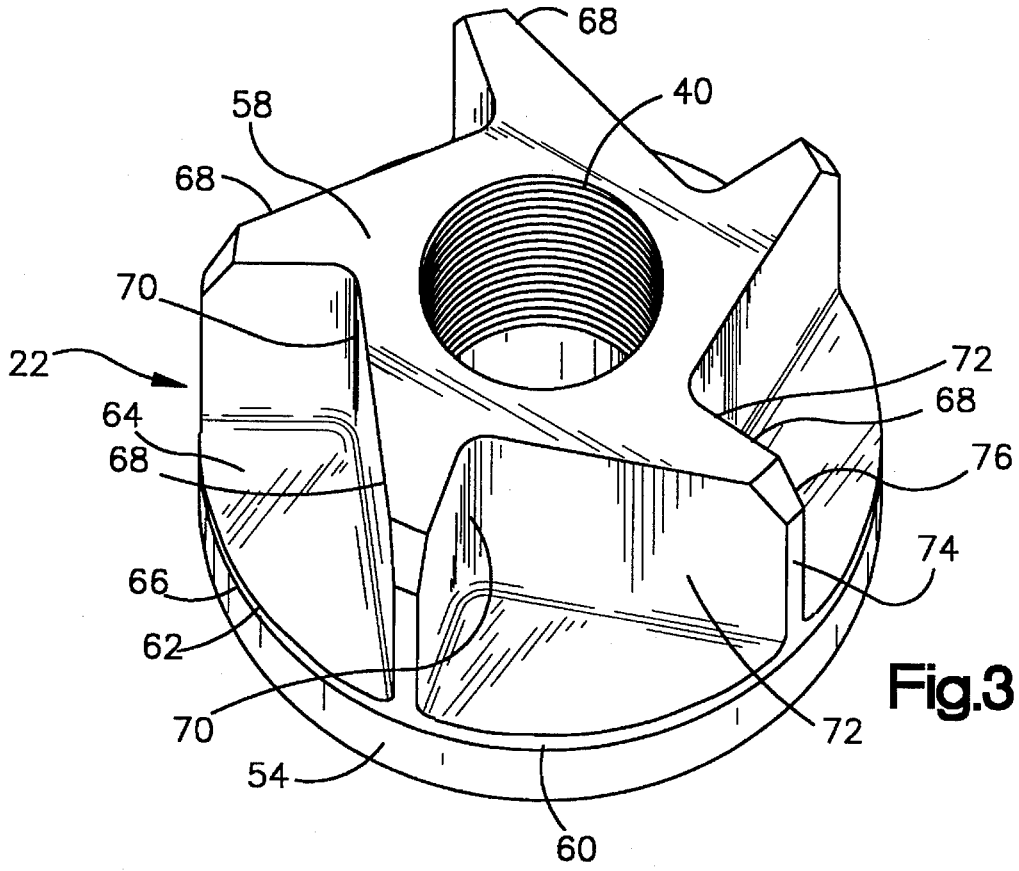
FIG. 3 is a perspective view of the impeller shown in FIG. 1.
Figure 4:
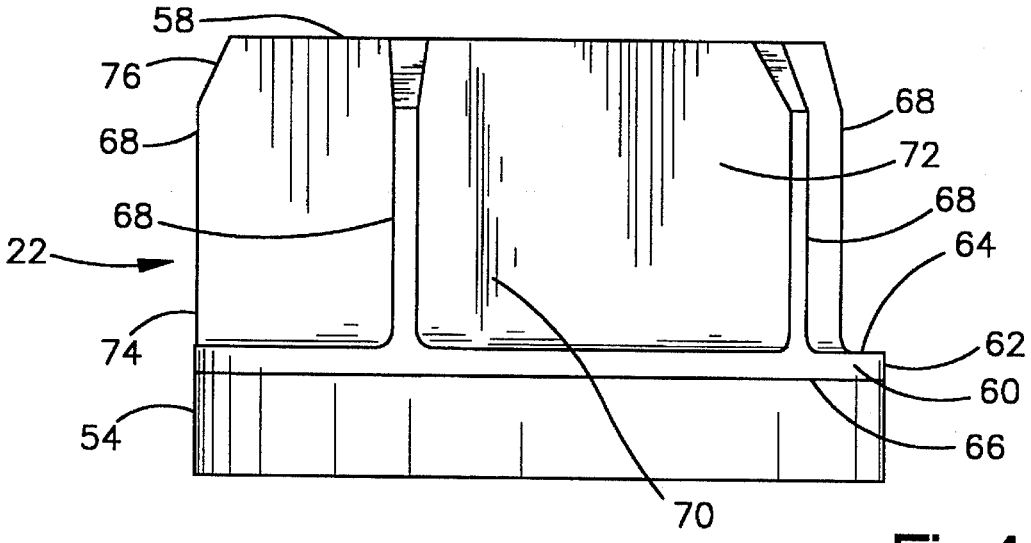
FIG. 4 is a side elevational view of the impeller shown in FIG. 1.

As shown best in FIGS. 2–4, the vanes 68 preferably extend substantially tangentially to the cylindrical hub 58. The vanes 68 preferably have a rectangular cross-sectional configuration, and are connected to one another by a curved surface 70. Each vane 68 has two sidewalls 72 that extend from the hub 58 to a vane end portion 74. The impeller 22 may include a tapered portion 76 at an upper portion of the vane ends 74, which is used to fit the impeller 22 into the impeller chamber 18. The upper tapered portion 74 may be configured differently or omitted, depending on the configuration of the impeller chamber 18 or of pump components therein. The vanes 68 each have a root portion adjacent the base portion 60 and a tip portion remote from the base portion at surface 58. The root portion is wider than the tip portion, as shown in FIG. 3.

The shaft 20 may include a refractory sleeve formed around it (not shown), which protects the shaft from oxidation and erosion by the molten metal. The shaft 20 may include a shaft bearing (not shown) which engages a corresponding bearing in the shaft sleeve 13 or the base 16. The shaft 20, shaft sleeve 13, impeller 22, impeller bearing 54, and base bearing 56 are composed of refractory material such as graphite or ceramic materials, to resist oxidation and erosion when these parts are subjected to the molten metal.

A volute member 78 is optionally used in the impeller chamber 18. The volute member 78 preferably has a spiral shape surrounding the impeller 22, as shown in FIG. 2. Due to the spiral shape of the volute member 78, a portion 80 of the volute member 78 is near the impeller 22, and a portion 82 of the volute member 78 is remote from the impeller 22. Use of a spiral volute such as the volute member 78 may produce advantageous molten metal flow properties as is known in the art.

In operation, the discharge pump 10 is lowered into the molten metal in the furnace and the motor 12 is activated to rotate the shaft 20 via the coupling assembly 34. Rotation of the shaft 20 rotates the impeller 22 and centrifugal forces created thereby cause molten metal to be fed into the top of the pump 10. The molten metal enters the multiple inlet openings 52 of the shaft sleeve 13, passes through the base inlet opening 42, and then passes into the impeller chamber 18. The molten metal is then directed by the impeller 22 toward the base outlet opening 44, where it passes through the passageway 53 of the base 16 and is discharged out the outlet opening 44 of the pump 10 to another bath of molten metal.

While not wanting to be bound by theory regarding the advantageous mechanisms behind the five-vaned impeller 22 of the invention vis-a-vis four bladed impellers, when a suspended body such as an impeller is subjected to a driving force, eg., rotation of the pump shaft, it is believed that the impeller will oscillate from the equilibrium position that it occupies at rest, and exhibit pendulum-like behavior. For a discussion of pendulum behavior and oscillation, see Paul A. Tipler, *Physics*, Worth Publishers, Inc., 330–340 (1982). After reaching a steady state, the amplitude of oscillation of the impeller will depend on the amplitude and frequency of rotation of the pump shaft. Due to the phenomenon of resonance, even when the driving amplitude of the pump shaft is small, the impeller may oscillate with a large amplitude if the driving frequency of the pump shaft is approximately equal to the natural frequency of the impeller.

When a two or four vaned impeller reaches the state of resonant vibration, i.e., the impeller is rotated at a critical rpm at which resonance occurs, the impeller bearing will strike the outer base bearing that surrounds it at approximately the same radial locations on the periphery of the impeller bearing. This will cause the two or four-vaned impeller and other connected pump components to have a short useful life. By being dynamically balanced with five vanes, the present impeller 22 distributes the impact of the base bearing 56 to different locations on the impeller bearing 54. This avoids the vibration problems from which two and four bladed impellers suffer.

The amplitude and frequency of oscillation of the impeller are believed to primarily be a function of the number of vanes used. With two and four vaned cylindrical hub impellers, the impeller bearing repeatedly strikes the base bearing on substantially the same radial locations on the periphery of the impeller bearing. If a shaft bearing is used, it also strikes a bearing surrounding it at substantially the same radial locations on the periphery of the shaft bearing. Other factors that affect impeller oscillation include the shaft length and diameter, the vane shape, thickness, and length, and the impeller diameter. The speed at which the shaft is rotated and its modulus of elasticity also influence impeller oscillation. The motor typically drives the shaft at between 300 to 400 rpm.

It is believed that impeller oscillation is further influenced by using refractory material as the composition of the shaft, shaft bearing, impeller, and impeller bearing. Unlike metals, refractory materials have varying porosity throughout their bulk. This variation in porosity leads to non-uniform density throughout the bulk of the impeller, the impeller bearing, the drive shaft, and the shaft bearing. By rotating these parts with non-uniform density, the oscillation of the impeller is further affected. Vibration problems do not occur when the impeller is made of metal, since metallic impellers have a homogeneous composition throughout their bulk.

Another factor which is believed to affect the oscillation of the impeller and the associated pump components is using a volute member. The portion 80 of the spiral volute member 78 is close to the impeller, while the portion 82 of the volute member 78 is remote from the impeller. With use of a spiral volute member 78, a transverse force is believed to be introduced to the oscillating impeller system. It is believed that the portion 80 that is closest to a rotating impeller will experience a higher pressure of molten metal than the portion 82 remote from the rotating impeller. This is believed to impart a transverse force to the impeller at the portion 80 which in turn forces the four-vaned impeller toward the remote portion 82 of the volute member 78. A portion of the impeller bearing at a location opposite to the applied transverse force thus strikes the base bearing 56 near the remote volute member portion 82. Thus, the transverse force caused by use of a volute member may also detrimentally affect the oscillation of the two and four-vaned cylindrical hub impellers.

The present impeller 22 advantageously overcomes all of the vibration problems of prior art cylindrical hub impellers. The impeller 22 has good displacement, and yet does not suffer the repeated impact problems that occur with two and four bladed cylindrical hub impellers. By employing five vanes 68, the impeller 22 is dynamically balanced and impact between the impeller bearing 54 and a shaft bearing occurs at different radial locations on the peripheries of these bearings upon each oscillation. This prolongs the useful life of the impeller 22.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. In a non-metallic pump for pumping molten metal including a shaft, a motor at one end of the shaft, an impeller at the other end of the shaft, and a base having a chamber in which the impeller is rotatable, the improvement comprising a dynamically balanced impeller made of a non-metallic, heat resistant material, comprising a circular base, a substantially cylindrical center hub portion located on the base, and five vanes extending from the base and outwardly from the hub portion, wherein said vanes are equally spaced around the periphery of the hub portion.

2. The improvement of claim 1 wherein said impeller includes a bearing at one end of the base.

3. In a non-metallic pump for pumping molten metal including a shaft, a motor at one end of the shaft, an impeller at the other end of the shaft, and a base having a chamber in which the impeller is rotatable, the improvement comprising a dynamically balanced impeller made of a nonmetallic, heat resistant material, comprising a cylindrical center hub and five vanes extending outwardly from the hub, wherein said vanes are equally spaced around the periphery of the hub and extend tangentially from the hub.

4. In an impeller for pumping molten metal having vanes, the improvement comprising a dynamically balanced impeller comprising a substantially cylindrical center hub portion, and five vanes extending outwardly from the hub portion, wherein the vanes are equally spaced around the periphery of the hub portion and extend tangentially from the hub portion, the impeller being made of non-metallic heat resistant material.

5. The impeller of claim 4 wherein the hub portion has in inner surface that defines a cylindrical bore and is internally threaded.

6. In an impeller for pumping molten metal having vanes, the improvement comprising a dynamically balanced impeller comprising an imperforate circular base, a substantially cylindrical hub portion centrally located on the base and five imperforate vanes extending outwardly from the hub portion to the circumference of the base, wherein the vanes are equally spaced around the periphery of the hub portion, extend substantially perpendicular from the base, and extend straight and tangentially from the hub portion, the impeller being made of non-metallic, heat resistant material.

7. In an impeller for pumping molten metal having vanes, the improvement comprising a dynamically balanced impeller made of non-metallic heat resistant material comprising a circular base, a cylindrical center hub portion located on the base, and five vanes extending from the base and outwardly from the hub portion, wherein the vanes are equally spaced around the periphery of the hub portion.

* * * * *